United States Patent [19]

Chabria

[11] Patent Number: 4,644,451

[45] Date of Patent: Feb. 17, 1987

[54] MINIATURE FLASHLIGHT WITH SOLDERLESS CONNECTIONS

[75] Inventor: Paul R. Chabria, West Chicago, Ill.

[73] Assignee: Press-A-Lite Corporation, West Chicago, Ill.

[21] Appl. No.: 765,548

[22] Filed: Aug. 14, 1985

[51] Int. Cl.[4] ..... F21L 7/00

[52] U.S. Cl. ..... 362/189; 362/200; 362/205

[58] Field of Search ..... 362/189, 200, 201, 202, 362/204, 205, 206, 208, 109, 157; D26/37

[56] References Cited

U.S. PATENT DOCUMENTS

| | | | |
|---|---|---|---|
| 1,940,023 | 12/1933 | Schulte | 362/208 |
| 2,156,462 | 5/1939 | Schulte | 362/200 |
| 3,330,949 | 7/1967 | Bush | 362/189 |
| 4,032,773 | 6/1977 | Halliday, Jr. et al. | 362/189 |
| 4,210,953 | 7/1980 | Stone | 362/205 |
| 4,419,718 | 12/1983 | Chabria | 362/205 |

*Primary Examiner*—William A. Cuchlinski, Jr.
*Assistant Examiner*—D. M. Cox
*Attorney, Agent, or Firm*—Lee, Smith & Zickert

[57] ABSTRACT

A miniature flashlight with solderless connections for electrical circuitry capable of illuminating a lamp by the squeezing of a flexible case holding said circuitry. The circuitry includes a spring switch arm capable of being depressed by squeezing said flexible case to achieve electrical communication between two batteries and complete the battery circuit in order to illuminate the lamp. The spring switch arm having a portion thereof in continuous contact with a positive terminal of one battery and having a portion being centrally hinged so that upon squeezing said flexible case the spring switch arm is limited in its bending to a portion between said hinge portion and a free end thereof to prevent inadvertent lighting of the lamp. The spring switch arm will slightly move against the positive terminal when pivoted whereby to self-clean the terminal during use. The batteries, lamp and spring switch arm are held by an insulative cartridge that holds the batteries in side-by-side relationship. The cartridge has flexible end walls which resiliently retain the batteries and clamp the lamp lead wires and spring switch arm by means of a longitudinal compressive force enabling the electrical connections to be solderless.

7 Claims, 11 Drawing Figures

3
13
12
10
11
31
32
4
36
38
2
37
39
21
2
27
33
40
28
20
26
14
15
48
35
24
47
25
46
45
18
17
16
23
44
42
43
19
30
41
49
22
29
34

13
12
10
11
31
21
36
33
37
48
15
35
17
50
47
45
26
46
43
19
44
41
22
42

11
17
22
15
14
23
33
13
19
49
28
40
31
42
41
32
27
25
24
20
41
16
43
48
44
46
26
47
50
45

39
38
21
32
20
48
14
16
18
11
34
49
22

21
14
40
24
39
25
37
36
38
50

MINIATURE FLASHLIGHT WITH SOLDERLESS CONNECTIONS

BACKGROUND OF THE INVENTION

The present invention relates in general to flashlights and the electrical circuitry and connections therefor, and is more particularly directed to a miniature pocket flashlight having a flexible exterior case which, when squeezed, depresses an internal switch to complete the circuit and illuminate a lamp.

Various styles of miniature flashlights have enjoyed considerable commercial success due to their compactness, utility and reliability. Certain types of known flashlights employ soldered, welded or riveted connections. Exemplary of these are U.S. Pat. Nos. 4,429,352; 4,122,510; 3,796,869; and 3,330,949. The present inventor has had U.S. Pat. No. 4,419,718 issued to him which discloses the use of a switch wire, tightly coiled around the positive terminal of one battery, and a lead wire for the lamp wound about the positive terminal of a second battery. On the other hand, U.S. Pat. Nos. 4,443,833 and 4,032,773, provide solderless connections which rely upon certain crimping techniques and the aid of a flexible cover end cap retaining a metallic switch element against the terminal of a battery.

Usually, these miniature flashlights are designed for keeping in a purse, pocket or briefcase. They have generally been made disposable whereby the batteries cannot be replaced once exhausted due to their encasement in a sealed flexible covering member.

Of critical importance to the reliability of such flashlights is the prevention of the inadvertent activation of the switch, such as when the flashlight is placed in a purse and comes into contact with other surrounding items. Additionally, the prevention of shorting between the negative and positive terminals caused by excessive bending of the switch means arranged near one of the batteries is important to the longevity of the flashlight. The device disclosed in U.S. pat. No. 4,419,718 alleviates, to a large extent, the inadvertent electrification of the lamp, as well as avoiding the short circuit problem with the battery to which the switch means is in contact with the positive terminal thereof, by means of a unique fulcrum-like design for the switch means. The present invention is a combination with, and an improvement upon, certain features of the aforementioned patent in a unique flashlight assembly.

The reliability of miniature flashlights is very important since, for example, they may be called upon to operate when a person is hurriedly searching for his or her house keys in an attempt to unlock an outside door during the evening hours. Manufacturing costs must also be kept to a minimum to maintain competitive advantage. The flashlights disclosed in several of the noted patents require solder connections for electrically joining the batteries and switch to the lamp. In addition to the potential problems with poor solder connections, the soldering processes require additional equipment and labor. A primary goal of the invention is to provide a flashlight having a resilient cartridge-type holder for the accommodation of a pair of batteries, a lamp, and electrical circuitry for the illumination of the lamp capable of being switch activated by means of squeezing a flexible case containing the cartridge, wherein the electrical connections are obtained by a compressive holding action of the cartridge involving no soldered connections.

A further goal of the invention is to provide a miniature flashlight that incorporates a squeeze-activated switch arm that bends only along a limited portion thereof whereby to avoid inadvertent electrification of the lamp and also the prevention of a short circuit between the terminals of one of the batteries.

It is a further goal of the invention to provide for a flexible switch arm that is arranged with a cartridge in such manner as to chafe against the positive terminal of the battery to which it is connected, whereby to clean the connection and eliminate corrosive buildup.

It is yet another object of the invention to provide a flashlight cartridge that securely spaces two batteries one from the other, which is capable of use with batteries having either insulated-type casings or uninsulated casings, whereby the miniature flashlight has the capability of receiving replacement batteries, or may be made to be disposable.

A concomitant goal of the invention is to also provide a cartridge-holder for a miniature flashlight capable of use with a switch arm that includes a fulcrum bend to allow only a limited portion of the switch arm to be bent, and/or wherein the cartriidge provides a central median pivot point intermediate the batteries whereby the switch arm abuts and pivots against the median to achieve the limited bending objective while being bent to complete the electrical circuit.

It is a further objective to provide a cartridge having opposing end walls capable of a wedging-engagement with batteries and wherein lead wires from the lamp are held by a compressive force once the batteries are resiliently inserted in the proper position.

It is additionally a goal to provide a conductor strip that is engageable with the cartridge and negative terminal of battery which is arranged to be contacted by the switch arm whereby insulated batteries may be utilized, or alternatively the uninsulated variety can be substituted therefor.

In summary, the miniature flashlight of the present invention employs a flexible outer case which contains a cartridge for holding a pair of batteries and electrical circuitry for the illumination of a lamp. The cartridge is provided with a twin cradle-portion for retention of the batteries and having, at opposite ends thereof, a pair of opposing resilient end walls capable of clamping lamp lead wires against the terminals of the batteries and retaining a switch arm arranged to complete the circuit and thereby illuminate the lamp when the user squeezes the flexible outer casing against the switch arm. One end wall supports the lamp and provides slit means for the receipt therethrough of the lamp lead wires to be fed onto raised interior portions of the end wall against which the batteries are held in compression. The switch arm is preferably double-bent near the middle whereby to provide an integral fulcrum to minimize the bending portion of the switch arm in alleviation of both the short circuiting and inadvertent electrification problems found in the prior art. A divider median portion of the cartridge separates the battery cradles and is cooperatively aligned with the switch arm to act as an optional pivot point for the arm to thereby reduce the bending length of the switch arm and thus require a relatively firm squeeze to depress it in order to prevent inadvertent activation of the electrical circuitry when the flashlight is stored in a purse, pocket, briefcase, or the like.

The end wall opposite the wall that supports the lamp includes means for receiving a portion of the switch arm below the positive terminal of one of the batteries whereby the battery terminal compressively contacts with the switch arm and wherein the switch arm, during squeezing and releasing of the flexible case, moves against the positive terminal to thereby abrade the terminal, keeping it clean from corrosion and build-up.

The cartridge is formed to accommodate either insulated or uninsulated batteries. The compressive action of the resilient end walls that hold the batteries allows for the utilization of a conductor strip to be arranged with the negative terminal of an insulated battery and extend along the battery to be disposed in the bending path of the switch arm, so that the switch arm may contact the conductor strip when depressed. The conductor strip may be eliminated when uninsulated battery casings are provided since the switch arm then simply contacts the exterior, or negative, metal casing of the battery to complete the circuit.

A cap is either removably or fixedly arranged with the flexible casing and provides an opening for the lamp to extend therethrough. In the fixed arrangement, upon the exhaustion of the batteries, the flashlight may be discarded. Alternately, a removable cap may be snap-engaged with the flexible casing whereby upon the exhaustion of the batteries, the cap may be removed and the cartridge and electrical circuitry removed as a unit in order to replace the batteries. In the latter form of the invention, the lamp may also be replaced when it has burned out.

The invention is largely characterized by the solderless connections made possible by the resiliently biased assemblage of the batteries and cartridge to secure the electrical connections therebetween.

The foregoing advantages are made possible by a cartridge which, in one embodiment of the invention, has, in cross section, a rounded W-shape configuration providing two parallel cradles opening outwardly in the same direction for retention of batteries in side-by-side relationship between top and bottom opposing end walls flexibly formed at opposite ends of the cradles. Along the peak of the W, a median strip is formed which may include a raised portion to act as a fulcrum for the pivoting of a spring arm compressively held at its lower end between a pair of upstanding ribs located on the bottom end wall of the cartridge to receive the positive terminal of one battery. The switch arm may be straight or may include a bent central portion which also acts as a fulcrum to limit bending to a limited portion of the switch arm. The switch arm is adapted to pivot and complete contact with the negative terminal of the second battery when the flexible case is squeezed. Additionally, a second battery experiences a compressive force when inserted in the other cradle against a raised portion of the opposite upper end wall to secure one of the lamp lead wires. The bottom of the first battery abuts against another raised portion on the upper end wall, whereby to compress the other lamp lead wire thereagainst, and is also wedged against another raised portion on the bottom end wall. Thereby both batteries experience a compressive force caused by flexing of the end walls upon insertion of the batteries into the cradles.

In another embodiment of the invention, the cartridge has an S-shape in cross section wherein the cradles open in opposite directions and the batteries are thereby separated by a reverse curve central portion. A portion of the reverse curve central portion may be used as an optional fulcrum point for either a straight or bent switch arm when depressed. The opposite end walls may include raised areas and ribs for the retention of the positive terminal ends and the bottom ends of the batteries similar to the first mentioned embodiment. In both embodiments, the batteries may be of either the insulated or the uninsulated variety. For the insulated variety, a conductor strip extends from the bottom negative terminal of one of the batteries upwardly into the path of the depressed spring arm whereby to facilitate completion of the circuit upon flexure of the outer casing.

The spring arms for either of the two disclosed embodiments may be substantially the same and include similar bent fulcrum portions for minimizing the bending of the switch arm. In all cases, the arrangement of the portion of the switch arm at the positive terminal of one of the batteries is provided to have a slight movement, whereby to chafe against the positive terminal to create a cleaning action.

Other advantages and features of the invention will become apparent from the detailed description hereinafter taken in conjunction with the drawings.

DETAILED DESCRIPTION OF THE INVENTION

It should be explained at the outset that the miniature pocket flashlight is of the type which includes an outer flexible case that protects the internal parts from the environment as well as serving as the means for depressing the switch for completing the circuit and illuminating the lamp. The case is flexible over the majority of the outer lateral surfaces of the flashlight.

A principal characterizing feature of the invention is that it can be assembled very efficiently without requiring solder connections or separate fasteners. This is accomplished by the provision of a resilient cartridge which secures the electrical connections by virture of a compressive force created by the wedging-engagement of the batteries therein. The additional cost and labor incurred by previously used solder connections, as taught in the cited patents, is thereby eliminated.

Figure 1:
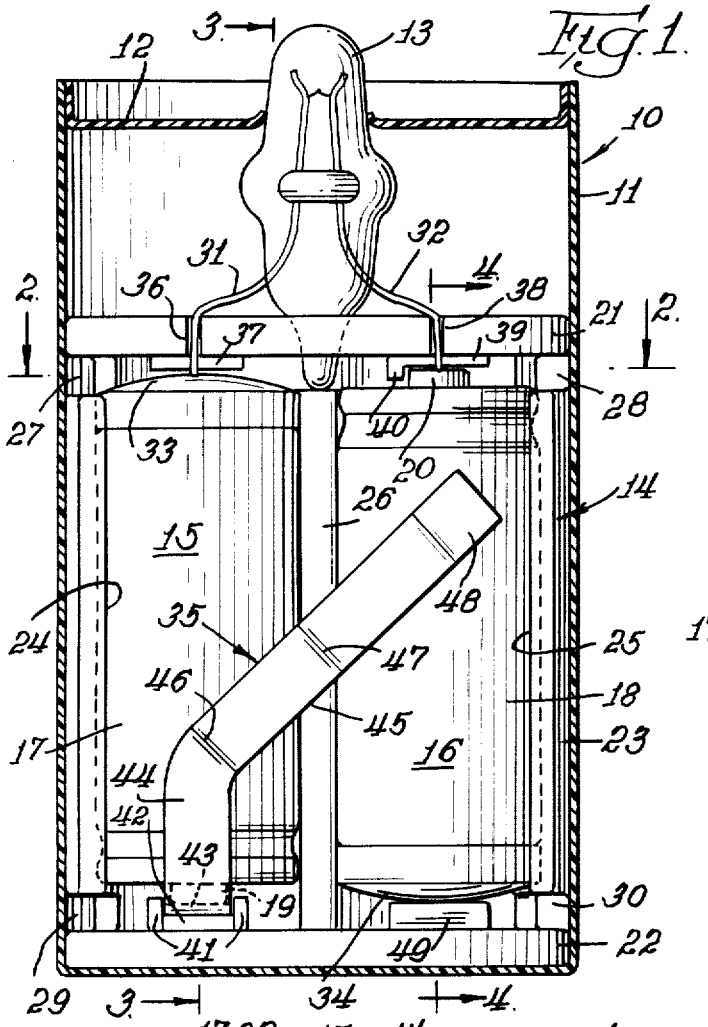
FIG. 1 is a sectional view taken along a vertical plane through the outer flexible casing and disclosing the inventive battery cartridge retaining a pair of batteries and an electrical switch circuit for illumination of a lamp held at the top of the cartridge.

More particularly, attention is first directed to FIG. 1, wherein a flashlight 10 is provided with a flexible case 11, shown in section, and having a cap 12 arranged at an upper open portion thereof. The cap 12 is centrally open to receive therethrough the upper portion of a lamp 13. A cartridge 14 acts as an insulator and holding means for a pair of batteries 15 and 16, arranged side-by-side, and inverted one to the other, therein. In this embodiment of the invention, the batteries 15 and 16 have uninsulated canisters 17 and 18 which are the negative terminals. Battery 15 includes a centerpost positive terminal 19 disposed at the bottom of the cartridge 14 and battery 16 has a centerpost positive terminal 20 oppositely facing to be arranged at the top of the cartridge 14.

Figure 2:
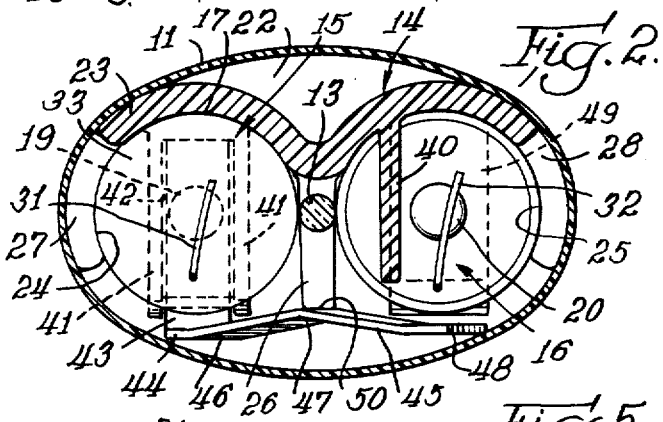
FIG. 2 is a cross-sectional view of the invention taken along line 2—2 of FIG. 1, and showing in dashed lines the bottom end wall for the resilient securement of the batteries.

The cartridge 14 includes a top wall 21 spaced-apart from an opposing lower wall 22. Integrally joining the walls 21 and 22 is, in cross section, a generally W-shaped holder section section 23 providing a pair of concave battery cradles 24 and 25, as best viewed in FIG. 2. The cradles 24 and 25 are joined along the center line of the cartridge 14 at a median divider 26, generally being the center peak of the W-shape. The batteries 15 and 16 nestingly rest within the cradles 24 and 25 at either side of the median divider 26. The side edges of the walls 21 and 22 are not fully joined to the top holder section 23 at arcuate cut-outs 27 and 28 provided at the bottom wall 22. Thereby, the walls 21 and 22 are to a degree hingedly connected in a flexible manner to the holder section 23. This flexible hinging provision allows for a snap, or wedging, insertion of the batteries 15 and 16 whereby an axial compressive force is created by the flexed walls 21 and 22 during retention of the batteries. It will be observed that the end walls 21 and 22 also are not joined to the median divider 26, which enhances the hingedly flexibility. The upper edge of median 26 stops short of the wall 21 in order to also permit the base of the lamp 13 to extend through a central axial aperture in the top wall 21 so that the lamp 13 held by both the cap 12 and the top wall 21 at two locations therealong.

The lamp 13 includes lead wires 31 and 32 which also conveniently extend through the top wall 21 as will be hereinafter described.

It will be observed that the battery 15 includes a base 33 which also forms part of the negative terminal of the canister 17. Similarly, the oppositely directed battery 16 includes a base 34 which forms part of the negative terminal with the canister 18. Contact with the negative canister 18 is provided by means of a spring switch arm 35 arranged between and over the batteries 15 and 16. In order for the lead wire 31 to be placed in electrical communication with the battery 15, the top wall 21 includes a wire slot 36 through the top wall 21, generally above the base 33. A raised area 37 etends downwardly from the top wall 21, whereby the lead wire 31 passes through the wire slot 36 and is disposed horizontally across the raised area 37 to be in contact with the base 33. The opposite lead wire 32 is similarly arranged through a wire slot 38 extending through the top wall 21 generally above the positive terminal 20 of battery 16. Another raised area 39 is provided through the top wall and further includes an optional positioning rib 40 for guiding and holding the positive terminal 20 against the raised area 39 with the lead wire 32 sandwiched therebetween.

Grooves may optionally be cut in the raised areas 37 and 39 whereby the lead wires 31 and 32, repsectively, may be seated. Such grooves would not be greater than the diamter of the lead wires 31 and 32 in order that the base 33 and positive terminal 20 make contact with the lead wires. The arrangement of the lead wire 31 in association with the bottom negative terminal battery 15 is best viewed in FIG. 3.

Figure 3:
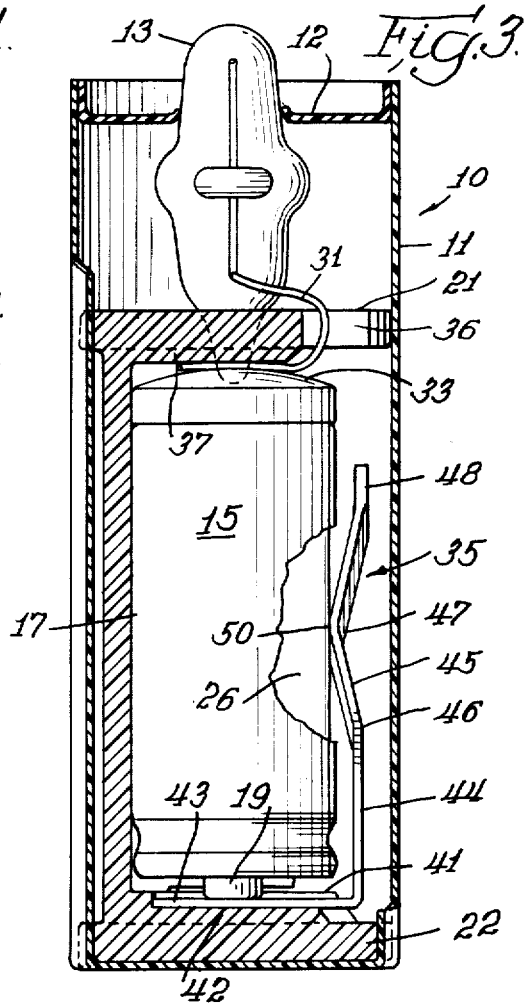
FIG. 3 is a cross-sectional view of the invention taken along line 3—3 of FIG. 1.

At the bottom wall 22, a pair of parallel ribs 41 are provided to straddle a raised area 42, of a lesser height therebetween, whereat the positive terminal 19 of the battery 15 is slid inwardly to reside within the cradle 24 of the cartridge 14. The outward facing edges of the raised portions 37 and 42 may be inclined, as shown in FIG. 3, so that the battery may be wedged inwardly into the cradle position 24. Thereby, the battery 15 is aided during engagement to outwardly flex the walls 21 and 22.

Also arranged atop the raised portion 42 is a horizontal lower end portion of the spring switch arm 35, indicated by reference numeral 43. By applying a slight upward force on battery 15, the horizontal portion 43 may be slidingly inserted between the positive terminal 19 and raised area 42 so to be held therebetween. The spring switch arm 35 is a conductive metallic element which provides means for completing the circuit. A vertical portion 44 of spring switch arm 35 extends upwardly from the horziontal portion 43 generally over the battery 15 and terminates in a diagonal arm 45 extending across the median divider 26. As explained in U.S. Pat. No. 4,419,718, it is desirable for a spring switch arm to have a limited bending portion so that inadvertent slight pressure does not bring the diagonal arm 45 into contact with the battery 16 at the negative terminal 18. Accordingly, the diagonal arm 45 is provided with a bend 46 and rebend 47 which creates a fulcrum whereby the portion of the diagonal arm 45 upwardly of the rebend 47 is the major bending portion of the spring switch arm 35. The arm 45 may further include an end bend 48 whereby to bring the arm 45 back into a generally parallel arrangement with the plane of the vertical portion 44. The end bend portion 48 is the major contact point with the canister 18 of the battery 16, best viewed in FIGS. 2 and 3.

Figure 4:
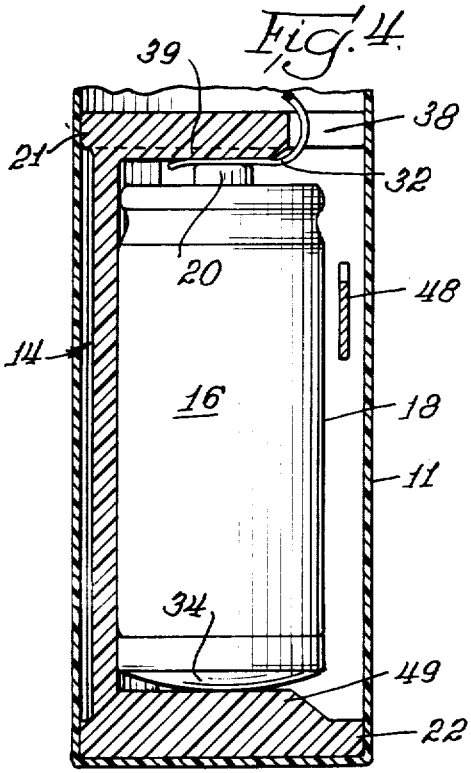
FIG. 4 is a cross-sectional view of the invention taken along line 4—4 of FIG. 1.
Figure 5:
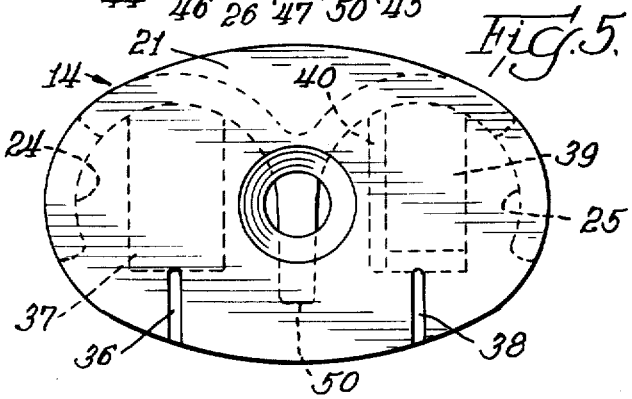
FIG. 5 is a top view of the invention shown in FIG. 1 having a lamp, batteries and switch arm removed.

In a configuration similar to raised area 37, the bottom wall 22 includes a raised area 49 for the wedging abutment of the bottom 34 of the battery 16, as shown in FIG. 4. The leading edge of the raised area 49 may be bevelled whereby to facilitate the sliding, or wedging, insertion of the base 34 thereupon.

In furtherance of the goal of limiting the bending portion of the spring switch arm 35, the median divider 26 may be provided with a raised middle section 50 which provides for a pivoting contact of the switch arm 35 upon squeezing the case 11. As a result, in an optional design, the diagonal arm 45 may be flat and the raised middle section 50 will then alone provide for the fulcrum action during bending. However, both the raised central section 50 and the bends 46 and 47 may be present whereby to provide complementary means for limiting the bending action of the spring switch arm 35. This fulcrum action also aids in preventing the inadvertent shorting of the battery 15 which might otherwise occur upon forceful squeezing of the case 11 in that the diagonal portion 45 would contact the canister 17 creating a short circuit between the positive and negative terminals of the battery 15.

The flashlight 10 therefore provides a cartridge 14 which solely holds the electrical circuitry, including batteries, lamp and switching means, and wherein the cartridge with the lamp, batteries and spring switch arm may be easily assembled without soldering. The compressive force caused by the insertion of the batteries 15 and 16 into the holder section 23 securely holds the lamp lead wires 31 and 32 at the top wall and provides a clamping action for the horizontal portion 43 of the spring arm 35. It will be observed that a secondary benefit is achieved in this arrangement whereby the horizontal portion 43 of the switch arm 35 is caused to slide during the depression and release of the spring arm portion 45. This back-and-forth action causes a chafing of the terminal 19 so that it is cleaned during operation to prevent corrosion build-up. As a result, the fulcrum action created by the bent portions of the diagonal 45, complemented by the provision of the optional raised middle portion 50, promotes this sliding action by the horizontal portion 43 across the terminal 19.

FIGS. 6–11 illustrate another embodiment of the invention. For ease of explanation, reference numerals 110–150 are provided to generally correspond to the elements 10–50 shown in FIGS. 1–5; but, however, having the modifications as hereinafter explained.

Figure 6:
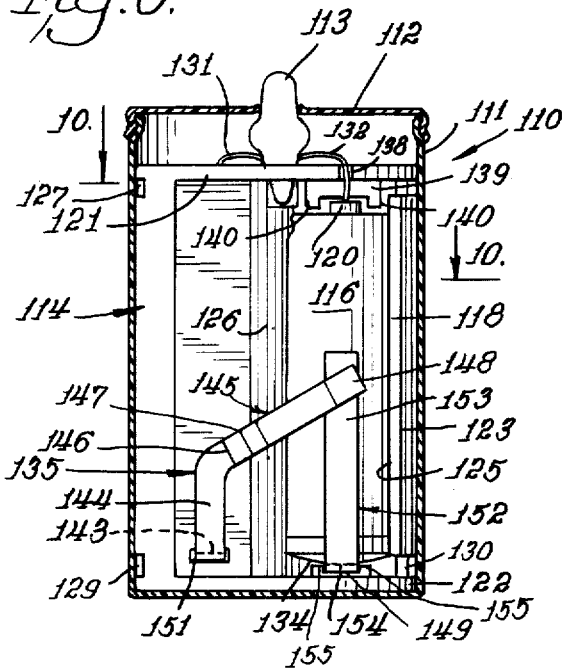
FIG. 6 is a vertical sectional view of another embodiment of the invention utilizing a differently shaped cartridge and showing the cartridge resiliently holding a pair of batteries and the electrical switch circuitry for the illumination of the lamp held at the top wall of the cartridge.

In FIG. 6 it will be observed that a miniature flashlight 110 is disclosed and includes a flexible case 111 having a cap 112 thereover. In the disclosed embodiment, cap 112 is made to be snap-fit with the case 111 whereby to be removable. In flashlight 10, the cap 12 is shown fixedly attached, by an adhesive for example, to the case 11 so that upon the exhaustion of the batteries 15 and 16, the user discards the flashlight. Of course, cap 12 may be made removable, as will be clear from the following. Flashlight 110 provides for the removability of the cap 112 so to enable the replacement of the batteries as well as a burned-out lamp. A lamp 113 extends through a central aperture of the cap 112. A cartridge 114 is provided, but has a generally S-shape in cross section, best seen in FIGS. 9 and 10.

Figure 8:
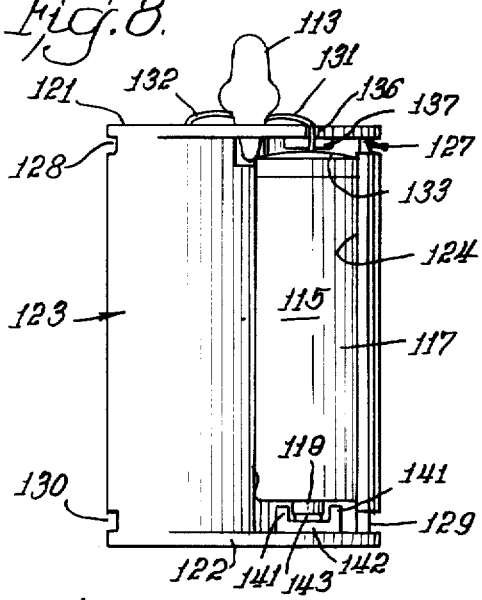
FIG. 8 is a back view of the invention as shown in FIG. 6.
Figure 9:
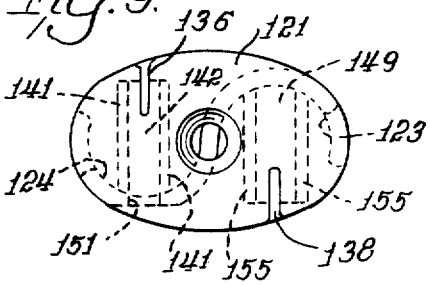
FIG. 9 is a top view of the invention as shown in FIG. 6 having the lamp, batteries and electrical switch circuitry removed.
Figure 10:
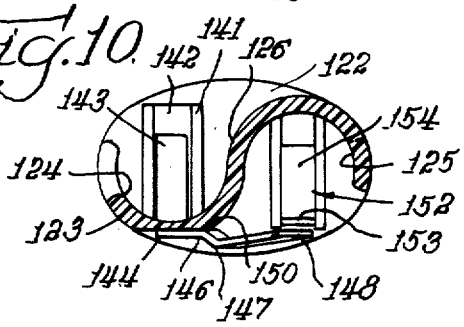
FIG. 10 is a cross-sectional view of the invention taken along line 10—10 of FIG. 6.

Insulated batteries 115 and 116 are arranged interiorly of the cartridge 114. These batteries may be of the alkaline variety well known in the industry. Battery 115 includes an insulated jacket 117 and battery 116 has an insulated jacket 118. The centerpost positive terminal of the battery 115 is shown in FIG. 8 at reference numeral 119, and, with reference to FIG. 6, the centerpost positive terminal of battery 116 is shown at reference numeral 120 to be oppositely directed from positive terminal 119. The positive terminal 120 associates with the top wall 121 of the cartridge 114, and the positive terminal 119 associates with the bottom wall 122 thereof. The top and bottom walls 121 and 122 are opposingly faced and affixed to a central battery holder section 123. The holder section 123 is formed to have an S-shape in cross section, as mentioned above, and includes oppositely directed concave cradles 124 and 125 for the nesting of the batteries 115 and 116. A central reverse curve divider 126 integrally interconnects the cradles 124 and 125, as shown in FIG. 10. To achieve a resilient hinging relationship between the walls and holder section 123, cut-outs are also provided. With reference with FIGS. 6 and 8, it will be seen that the cradle 124 has a cut-out 127 at the upper wall 121 whereby the full curved shape is not completely connected to the top wall 121. Similarly, a cut-out 128 is provided between the cradle section 125 and the top wall 121. At the lower wall 122, the cradle 124 is cut-out at 129 and the cradle 125 is cut out at 130. Thereby, the full S-shape is not connected to the walls 121 and 122, similar to the arrangement for the cartridge 14 shown in FIG. 1. As best viewed FIG. 8, it will also be observed that the divider section 126 is terminated short of the top wall 121, whereby to provide a space for the extension of the base of the lamp 113 through the top wall 121.

Lamp 113 includes a pair of lead wires 131 and 132 which are provided to communicate with the negative terminal of battery 115 and positive terminal of battery 116, respectively.

The base of battery 115 is shown at reference numeral 133 for contact by the lead wire 131. The negative terminal of battery 116 is provided at reference numeral 134 arranged in the opposite direction to that of the negative terminal 133. A spring switch arm 135 extends across the batteries 115 and 116, which may be depressed when squeezing the case 111, similar to the action of the spring switch arm 35 shown in FIG. 1. The engagement of the lead wire 131 with the base 133 is made possible by a wire slot 136 extending laterally into the top wall 121, as shown in FIG. 8. The lead wire 131 passes through the slot 136 and is arranged over a raised area 137 formed on the top wall 121 generally axially above the battery 115. Thereby, the base 133 wedgingly contacts against lead wire 131. The second lead wire 132 is similarly arranged in a wire slot 138 extending laterally into the top wall 121 whereby the lead wire 132 is passed over a raised area 139 formed on the top wall 121 generally axially above the battery 116. A pair of raised ribs 140 are provided to either side of the raised area 139 and spaced apart sufficiently to accommodate the positive terminal 120. Thereby, the positive terminal 120 is guided over the raised area 139 and held thereon by the ribs 140 to be wedgingly associated with the lead wire 132. Both the raised areas 137 and 139 may be provided with a front bevel to facilitate the insertion of the batteries. Also, the raised areas 137 and 139 may be provided with an optional center groove, not shown, for the positioning of the lead wires 131 and 132 therein. Again, the diameter of such grooves would be less than the diameter of the lead wires so that the batteries may be placed into electrical contact with the lead wires.

The positive terminal 119 of the battery 115 associates with the bottom wall 122 by means of a pair of upstanding ribs 141 spaced apart sufficient to accommodate the battery terminal 119. The ribs 141 straddle a raised area 142, which wedgingly abuts the terminal 119 when the battery is inserted into the cradle 124. Again, the front surface of raised area 142 may be bevelled to facilitate the wedging insertion of the battery teriminal 119 thereover for a resilient flexing securement created by the bottom wall 122. As a result, the battery 115 is wedgingly and resiliently retained between the raised area 137 at the base 133 and the raised area 142 at the positive terminal 119.

The conformation of the spring arm 135 is preferably generally the same as that for the spring arm 35. A horizontal portion 143 thereof is slidingly engaged between the raised area 142 and battery terminal 119 through the cradle 124 by a positionally corresponding slot means hereinafter described. Extending upwardly from the horizontal portion 143 is a vertical portion 144 that terminates in a diagonal portion 145 which extends across the divider 126 to be positioned over the battery 116. However, when using insulated batteries, the diagonal portion 145 may be shortened, as explained herinafter, and, for example, may terminate generally above central reverse curve divider 126, rather than extending past it. A bend 146 and re-bend 147 provide the fulcrum action for the spring switch arm 135 whereby the portions upward of the fulcrum receive the majority of the bending of the arm 135, thereby requiring more than just slight pressure to depress the arm 135. An optional bent end 148 may be provided at the tip of the diagonal portion 145 whereby to bring the portion 145 substantially parallel to the vertical portion 144.

Figure 7:
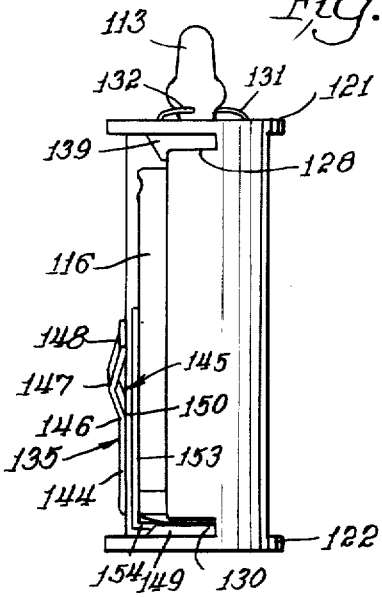
FIG. 7 is a side view of the invention as shown in FIG. 6.

It will be seen from FIGS. 6 and 7 that the bottom negative terminal 134 of the battery 116 is wedgingly associated with the bottom wall 122 by means of a raised portion 149 thereon, as more fully explained below.

An additional fulcrum-like action is provided along a portion of the reverse curve 126, generally shown at point 150, whereat the diagonal portion 145, adjacent the double bend 146, 147, will contact the holder section 123 when the spring arm 135 is depressed. Thereby, the actions of the double bend fulcrum 146, 147, along with the pivoting contact of the diagonal portion 145 at point 150, cooperate to minimize the bending of the spring switch arm 135 to a limited extent therealong extending upwardly from the fulcrum and thereby greatly reduces the possibility that the spring switch arm 135 will be accidentally depressed while being carried in a purse, pocket or brief case. Of course, as will be explained, diagonal portion 145 may be shortened, for example to terminate just above divider 126, which will inherently limit bending and reduce the chance of accidental illumination.

The arrangement of the horizontal arm portion 143 at the raised area 142 is accomplished by the provision of a slot means 151 extending through the bottom of the cradle portion 124 to be aligned with, and generally in the same plane as, the raised area 142. Thereby, the spring switch arm 135 enters the cradle section 124 directly below the positive terminal 119 for electrical communication therewith. As with the spring switch arm 35 shown for flashlight 10, the pivoting action of the spring switch arm 135 causes the horizontal portion 143 to chafe against the bottom of the terminal 119 whereby to scrape it clean during use and thereby avoid corrosion and build-up. Thus, a self-cleaning feature is provided for the flashlight 110.

Figure 11:
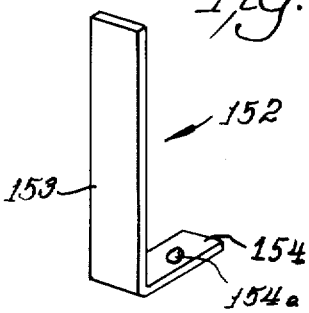
FIG. 11 is a perspective view of a conductor strip shown in FIG. 6.

Since the flashlight 110 is provided with insulated batteries 115 and 116, the spring switch arm 135 must be placed in electrical communication with the negative terminal 134 when it is depressed toward insulated jacket 118. Therefore, means for electrical communication between the spring switch arm 135 and the negative terminal 134 is required. In this regard, an adaptor conductor 152, shown in FIG. 11, is provided to complete the electrical circuit. Conductor 152 is preferably an L-shaped strip of metallic and conductive material having a vertical portion 153 extending along and over the battery 116 and terminating in a lower horizontally bent portion 154 which is sandwiched between the base 134 and raised area 149. It should be clear that the purpose of the conductor 152 is to extend from the negative terminal into the path of the spring arm. Thus, the lengths and positions of the switch arm and conductor strip are not limited to the arrangement shown in the preferred embodiment and, for example, the diagonal portion 145 may, of course, be made in the shortened style to stop generally above divider 126, and the conductor 152 may then be made, or bent, to extend to the divider 126, such as at point 150, whereby to be in the bending path of the end of switch arm 135. To ensure good electrical contact, a dimple **154*a* may be formed in leg 154 and the angle between the legs may be slightly less than 90°, say 89°. Thereby, the spring switch arm 135 is made capable of being depressed to contact the conductor 152 instead of simply contacting the battery canister as with the battery 16 shown for the flashlight 10. To hold the horizontal portion 154 in place, upstanding ribs 155 are provided at either side of the raised area 149 to create holding and positioning means for the conductor 152 relative to the battery 116**.

It will be understood that the use of the conductor 152 may be provided for the flashlight 10 wherein it would be arranged to reside along the battery 116 and have the horzontal portion 154 between the raised area 49 and the bottom negative terminal of an insulated battery. Upstanding ribs, similar to ribs 155, may also be provided to hold the conductor 152 in proper position. Therefore, cap 12 would be made removable similar to cap 112 so that insulated batteries could be alternately used in the embodiment for the flashlight 10.

Alternatively, flashlight 110 may also be provided for use with the uninsulated batteries 15 and 16, wherein the conductor 152 would not be required, and spring switch arm 135 would be of a length, as shown in the drawings of the exemplary embodiment, sufficient to reach and contact the outer negative canister 18 of the battery 16 when such battery might be optionally used in place of the insulated battery 116, as would be understood. The cap 112 might then be adhesively secured to the flexible case 111 similar to that of the cap 12 used for the flashlight 10.

When the insulated-type batteries, such as the alkaline batteries shown at 115 and 116, are used, the miniature flashlight of the invention is therefore re-usable upon exhaustion of the batteries or upon the burning out of the lamp. Thus, depending upon the choice of manufacture, a disposable or a re-usable construction might be made for both the flashlights 10 and 110 by implemetation of the characterizing features of the invention herein disclosed.

It will also be observed that if uninsulated batteries are used with the flashlight 110, the spring switch arm 135 is not capable of contacting the negative casing of an uninsulated battery held in the cradle 124 due to its arrangement at the exterior thereof (FIG. 6). The switch arm 135 is inherently prevented from causing a short circuit with an uninsulated battery held in the cradle 124 since the curved wall of the cradle 124 acts as a barrier, and accordingly, the provsion of an optional raised section, such as shown at 50 for cartridge 14, would not be needed. The corresponding portion 150 of the cartridge 114 is therefore simply a pivot point along the reverse curve portion 126, which is not required to be raised like middle portion 50 to act as a spacer between the switch arm 135 and a negative canister of an uninsulated battery. Point 150 can then also be the stop point at which a shortened portion 145 moves down against which to contact and press a bent conductor 152 as would be clear to one skilled in the art.

It will also be appreciated that when uninsulated batteries are used in either of the flashlights 10 or 110, an adaptor conductor 152 might still be provided, to allow for subsequent use with insulated batteries, since the spring switch arms 35 and 135 will make contact through the conductor 152 to the negative canister terminal of the associated uninsulated battery therebelow.

A wide range of insulative materials are suited for the construction of the cartridges 14 and 114. Resilient-type hard rubbers, or rigid plastics, that have a certain degree of flexibility, are well suited to enable the top and bottom end walls to flex and compressively hold the batteries therebetween.

It will therefore be seen that a solderless miniature flashlight is provided which solves all the foregoing goals and objectives set forth and overcomes the deficiencies found in the prior art. Manufacture and assembly costs are greatly reduced by the elimination of any soldering steps. The compressively acting end walls of the disclosed cartridges act to provide a longitudinal force on the inserted batteries whereby the batteries secure the connections for the circuitry. The optional utilization of a median portion of the battery cartridge as a pivot, in cooperation with the bent fulcrum portion of the sprin switch arm, achieve the goal of minimizing the portion of the spring switch arm that is bent during depression, and thereby prevents the occurrence of inadvertent activation of the circuit by accidental slight squeezing of the flexible casing.

An important feature of the invention is the scraping of the positive terminal of one of the batteries by a lower horizontal portion of the spring switch arm whereby to prevent corrosion and maintain good contact with the positive terminal.

The invention provides for the optional utilization of either insulated or uninsulated batteries wherein either a removable or a sealed cap may be provided atop the flexible case of the miniature flashlight device. This feature is achieved by the utilization of an adaptor conductor which extends from the path of the depressed spring switch arm to the bottom end of one of the batteries. The cartridge is made of an integrally formed insulative material which has flexibly hinged end walls for resiliently holding a lamp, switch arm, conductor, and batteries as a unit with tight solderless connections.

It will be understood that various omissions, substitutions and changes in the form and detail of the invention as described herein may be made by those skilled in the art without departing from the true spirit and scope of the invention as defined by the appended claims. Therefore, it is the intention that the invention be limited only by the scope of the following claims.

What is claimed is:

1. A pocket flashlight having solderless electrical connections comprising:

a lamp having a pair of lead wires;

a pair of batteries, each having a centerpost positive termainal end and a negative terminal, one lead wire being in electrical communication with the negative terminal of a first battery and the other lead wire being in electrical communication with the positive terminal of the second battery;

a cartridge holding said batteries in side-by-side relationship and supporting said lamp and lead wires;

a spring switch arm supported by said cartridge having a lower portion thereof in continuous electrical communication with the positive terminal of said first battery and an extending portion capable of selectively establishing electrical communication with the negative terminal of the second battery to complete the electrical circuit and illuminate the lamp, said lower portion of the spring switch arm is movable against said positive terminal of the first battery upon depression of said spring switch arm whereby to rub against said positive terminal and provide a self-cleaning action therewith;

said cartridge having a battery-holding section including a pair of cradles to arrange said batteries to be spaced one from the other, opposing flexible end walls integrally formed with opposite ends of said holding section and capable of resiliently engaging said batteries therebetween to reside in said cradles, one said end wall including means for holding said lamp whereby said lead wires extend through said end wall to be retained between the end wall and said batteries, the other end wall including means for holding said lower portion of the spring switch arm in continuous communication with the positive terminal of said first battery, whereby said spring switch arm extends therefrom to have said extending portion thereof arranged over the first battery;

said spring switch arm being flexible whereby upon receiving a force at said extending portion is capable of being depressed to establish electrical communication between the positive terminal of said first battery and the negative terminal of said second battery without said extending portion contacting said first battery;

said cartridge, lamp, batteries, and spring switch arm being assembled together as a unit without solder connections whereby to be capable of being inserted into a flexible casing and whereby upon squeezing said flexible casing, said spring switch arm is depressed to establish said electrical communication between said batteries.

2. A pocket flashlight having solderless electrical connections comprising:

a lamp having a pair of lead wires;

a pair of batteries, each having a centerpost positive terminal end and a negative terminal, one lead wire being in electrical communication with the negative terminal of a first battery and the other lead wire being in electrical communication with the positive terminal of the second battery;

a cartridge holding said batteries in side-by-side relationship and supporting said lamp and lead wires;

a spring switch arm supported by said cartridge having a lower portion thereof in continuous electrical communication with the positive terminal of said first battery and an extending portion capable of selectively establishing electrical communication with the negative terminal of the second battery to complete the electrical circuit and illuminate the lamp:

said cartridge having a battery-holding section including a pair of cradles to arrange said batteries to be spaced one from the other, opposing flexible end walls integrally formed with opposite ends of said holding section and capable of resiliently engaging said batteries therebetween to reside in said cradles, one said end wall including means for holding said lamp whereby said lead wires extend through said end wall to be retained between the end wall and said batteries the other end wall including means for holding said lower portion of the spring switch arm in continuous communication with the positive terminal of said first battery, whereby said spring switch arm extends therefrom to have said extending portion thereof arranged over the first battery;

said spring switch arm being flexible whereby upon receiving a force at said extending portion is capable of being depressed to establish electrical communication between the positive terminal of said first battery and the negative terminal of said second battery without said extending portion contacting said first battery, wherein said extending portion of the spring switch arm extends from said lower portion in a plane across said batteries and terminates in a free end, and wherein said cradles are joined by a median divider, said divider including a raised portion extending upwardly and below said spring switch arm extending portion, whereby upon the depression of said spring switch arm said extending portion pivots against said raised portion generally midway between said free end and lower portion, whereby the bending of said spring switch arm is essentially limited to the portion thereof between said raised area and said free end;

said cartridge, lamp, batteries, and spring switch arm being assembled and held together as a unit without solder connections, or separate fasteners, whereby to be capable of being inserted into a flexible casing and whereby upon squeezing said flexible casing, said spring switch arm is depressed to establish said electrical communication between said batteries.

3. A pocket flashlight having solderless electrical connections comprising:

a lamp having a pair of lead wires;

a pair of batteries, each having a centerpost positive terminal end and a negative terminal, one lead wire being in electrical communication with the negative terminal of a first battery and the other lead wire being in electrical communication with the positive terminal of the second battery, wherein the negative terminals of said batteries comprise an exposed metal can negative terminal forming both the sides of the battery and an end of the battery opposite said centerpost positive terminal end;

a cartridge holding said batteries in side-by-side relationship and supporting said lamp and lead wires;

a spring switch arm supported by said cartridge having a lower portion thereof in continuous electrical communication with the positive terminal of said first battery and an extending portion capable of selectively establishing electrical communication with the negative terminal of the second battery to complete the electrical circuit and illuminate the lamp:

said cartridge having a battery-holding section including a pair of cradles to arrange said batteries to be spaced one from the other, opposing flexible end walls integrally formed with opposite ends of said holding section and capable of resiliently engaging said batteries therebetween to reside in said cradles, one said end wall including means for holding said lamp whereby said lead wires extend through said end wall to be retained between the end wall and said batteries, the other end wall including means for holding said lower portion of the spring switch arm in continuous communication with the positive terminal of said first battery, whereby said spring switch arm extends therefrom to have said extending portion thereof arranged over the first battery;

said spring switch arm being flexible whereby upon receiving a force at said extending portion is capable of being depressed to establish electrical communication between the positive terminal of said first battery and the negative terminal of said second battery without said extending portion contacting said first battery, whereby said spring switch arm is capable of being depressed so that said extending portion contacts the exposed metal can negative terminal of said second battery to complete said electrical circuit and illuminate said lamp;

said cartridge, lamp, batteries, and spring switch arm being assembled and held together as a unit without solder connections, or separate fasteners, whereby to be capable of being inserted into a flexible casing and whereby upon squeezing said flexible casing, said spring switch arm is depressed to establish said electrical communication between said batteries.

4. A pocket flashlight having solderless electrical connections comprising:

a lamp having a pair of lead wires;

a pair of batteries, each having a centerpost positive terminal end and a negative terminal, one lead wire being in electrical communication with the negative terminal of a first battery and the other lead wire being in electrical communication with the positive terminal of the second battery;

a cartridge holding said batteries in side-by-side relationship and supporting said lamp and lead wires;

a spring switch arm supported by said cartridge having a lower portion thereof in continuous electrical communication with the positive terminal of said first battery and an extending portion capable of selectively establishing electrical communication with the negative terminal of the second battery to complete the electrical circuit and illuminate the lamp;

said cartridge having a battery-holding section including a pair of cradles to arrange said batteries to be spaced one from the other, opposing flexible end walls formed at opposite ends of said holding section and capable of resiliently engaging said batteries therebetween, one said end wall including means for holding said lamp whereby said lead wires extend through said end wall to be retained between the end wall and said batteries, the other end wall including means for holding said lower portion of the spring switch arm in continuous communication with the positive terminal of said first battery, whereby said spring switch arm extends therefrom to have said extending portion thereof arranged over the first battery;

said spring switch arm being flexible whereby upon receiving a force at said extending portion is capable of being depressed to establish electrical communication between the positive terminal of said first battery and the negative terminal of said second battery without said extending portion contacting said first battery, and wherein said batteries are provided with insulated casings and wherein ends of said batteries opposite said centerpost positive terminal ends comprise the negative terminals and wherein conductor means extends from the negative terminal end of said second battery to be disposed in the bending path of the extending portion of the spring swtich arm whereby upon the depression of said spring switch arm, the extending portion contacts said conductor strip and completes the electrical circuit;

said cartridge, lamp, batteries, and spring switch arm being assembled together as a unit without solder connections whereby to be capable of being inserted into a flexible casing and whereby upon squeezing said flexible casing, said spring switch arm is depressed to establish said electrical communication between said batteries.

5. A pocket flashlight having solderless electrical connections comprising:

a lamp having a pair of lead wires;

a pair of batteries, each having a centerpost positive terminal end and a negative terminal, one lead wire being in electrical communication with the negative terminal of a first battery and the other lead wire being in electrical communication with the positive terminal of the second battery;

a cartridge holding said batteries in side-by-side relationship and supporting said lamp and lead wires;

a spring switch arm supported by said cartridge having a lower portion thereof in continuous electrical communication with the positive terminal of said first battery and an extending portion capable of selectively establishing electrical communication with the negative terminal of the second battery to complete the electrical circuit and illuminate the lamp:

said cartridge having a battery-holding section including a pair of cradles to arrange said batteries to be spaced one from the other, opposing flexible end walls integrally formed with opposite ends of said holding section for less than the full cross section of the holding section whereby to create flexible hinged connections therebetween and capable of resiliently engaging said batteries therebetween to reside in said cradles, one said end wall including means for holding said lamp whereby said lead wires extend through said end wall to be retained between the end wall and said batteries, the other end wall including means for holding said lower portion of the spring switch arm in continuous communication with the positive terminal of said first battery, whereby said spring switch arm extends therefrom to have said extending portion thereof arranged over the first battery;

said spring switch arm being flexible whereby upon receiving a force at said extending portion is capable of being depressed to establish electrical communication between the positive terminal of said first battery and the negative terminal of said second battery without said extending portion contacting said first battery;

said cartridge, lamp, batteries, and spring switch arm being assembled and held together as a unit without solder connections, or separate fasteners, whereby to be capable of being inserted into a flexible casing and whereby upon squeezing said flexible casing, said spring switch arm is depressed to establish said electrical communication between said batteries.

6. A pocket flashlight having solderless electrical connections comprising:

a lamp having a pair of lead wires;

a pair of batteries, each having a centerpost positive terminal end and a negative terminal, one lead wire being in electrical communication with the negative terminal of a first battery and the other lead wire being in electrical communication with the positive terminal of the second battery;

a cartridge holding said batteries in side-by-side relationship and supporting said lamp and lead wires;

a spring switch arm supported by said cartridge having a lower portion thereof in continuous electrical communication with the positive terminal of said first battery and an extending portion capable of selectively establishing electrical communication with the negative terminal of the second battery to complete the electrical circuit and illuminate the lamp;

said cartridge having a battery-holding section including a pair of cradles to arrange said batteries to be spaced one from the other, opposing flexible end walls formed at opposite ends of said holding section and capable of resiliently engaging said batteries therebetween, one said end wall including means for holding said lamp whereby said lead wires extend through said end wall to be retained between the end wall and said batteries, the other end wall including means for holding said lower portion of the spring switch arm in continuous communication with the positive terminal of said first battery, whereby said spring swtich arm extends therefrom to have said extending portion thereof arranged over the first battery;

said spring switch arm being flexible whereby upon receiving a force at said extending portion is capable of being depressed to establish electrical communication between the positive terminal of said first battery and the negative terminal of said second battery without said extending portion contacting said first battery;

said holding section of said cartridge being generally S-shaped in cross section wherein said cradles are outwardly concave in opposite directions, and wherein a reverse curve portion of the generally S-shape forms a median divider between said cradles separating said batteries to either side thereof, and wherein the means for holding said lower portion of the spring switch arm in communication with the positive terminal of said first battery includes a slot through a portion of the cradle of said S-shaped holding section holding said first battery, the extending portion of said spring switch arm extending outwardly of said cradle from said slot;

said cartridge, lamp, batteries, and spring switch arm being assembled together as a unit without solder connections whereby to be capable of being inserted into a flexible casing and whereby upon squeezing said flexible casing, said spring switch arm is depressed to establish said electrical communication between said batteries.

7. A pocket flashlight as claimed in claim 6 wherein said opposite end walls of said cartridge are integrally joined with said S-shaped holding section for less than the full cross section of the S-shape whereby to create flexible hinged connections therebetween.

* * * * *

UNITED STATES PATENT AND TRADEMARK OFFICE

CERTIFICATE OF CORRECTION

PATENT NO. : 4,644,451

DATED : February 17, 1987

INVENTOR(S) : Paul R. Chabria

It is certified that error appears in the above-identified patent and that said Letters Patent are hereby corrected as shown below:

At Col. 1, line 34, after the word "of", please delete the word "the".

At Col. 1, line 41, please delete the word "pat." and insert therefor the word — Pat. — .

At Col. 2, line 4, please delete the word "squeeze-activated" and insert therefor the word — squeeze-actuated — .

At Col. 2., line 25, please delete the word "cartriidge" and insert therefor the word — cartridge — .

At Col. 4, line 30, please delete the word "circuit" and insert therefor the word — circuitry — .

At Col. 5, line 28, after the word "holder" please delete the word "section".

At Col. 5, line 36, after the number "28" please insert — provided at the top wall 21, and at arcuate cut-outs 29 and 30 — .

At Col. 5, line 64, please delete the word "etends" and insert therefor — extends — .

At Col. 6. line 9, please delete the word "repsectively" and insert therefor the word — respectively — .

At Col. 6, line 11, please delete the word "diamter" and insert therefor the word — diameter — .

UNITED STATES PATENT AND TRADEMARK OFFICE

CERTIFICATE OF CORRECTION

PATENT NO. : 4,644,451

DATED : February 17, 1987

INVENTOR(S) : Paul R. Chabria

It is certified that error appears in the above-identified patent and that said Letters Patent is hereby corrected as shown below:

At Col. 6, line 14, after the word "terminal" please insert -- of --.

At Col. 11, line 24, please delete the word "sprin" and insert therefor -- spring --.

Signed and Sealed this

Fourteenth Day of June, 1988

*Attest:*

DONALD J. QUIGG

*Attesting Officer*

*Commissioner of Patents and Trademarks*